US007316635B2

(12) United States Patent
Hsieh

(10) Patent No.: US 7,316,635 B2
(45) Date of Patent: Jan. 8, 2008

(54) THIGH EXERCISER

(75) Inventor: Chin-Hsun-King Hsieh, Nan-Tou Hsien (TW)

(73) Assignee: Strong Power Engineering Consultant Ltd. Co., Nan-Tou Hsien (TW)

( * ) Notice: Subject to any disclaimer, the term of this patent is extended or adjusted under 35 U.S.C. 154(b) by 30 days.

(21) Appl. No.: 11/440,741

(22) Filed: May 24, 2006

(65) Prior Publication Data

US 2007/0275837 A1 Nov. 29, 2007

(51) Int. Cl.
*A63B 21/008* (2006.01)
*A63B 21/05* (2006.01)

(52) U.S. Cl. ..... 482/111; 482/128

(58) Field of Classification Search ..... 482/111–115, 482/121, 122, 126, 128, 73, 907
See application file for complete search history.

(56) References Cited

U.S. PATENT DOCUMENTS 3,861,677 A * 1/1975 Wheeldon ..... 482/113
4,022,463 A * 5/1977 Scott, Jr. ..... 482/122
4,185,818 A * 1/1980 Brentham ..... 482/112
4,240,627 A * 12/1980 Brentham ..... 482/112
4,625,960 A * 12/1986 Gvoich et al. ..... 482/113
4,722,016 A * 1/1988 Shirako et al. ..... 360/128
5,518,482 A * 5/1996 Hsieh ..... 482/130
6,733,426 B2 * 5/2004 Bussell ..... 482/112
2007/0072751 A1 * 3/2007 Hsieh ..... 482/112

* cited by examiner

*Primary Examiner*—Stephen R. Crow
*Assistant Examiner*—Allana Lewin
(74) *Attorney, Agent, or Firm*—DLA Piper US LLP

(57) ABSTRACT

A thigh exerciser includes a pair of horizontal first and second swing rods each having a pivot end portion connected pivotally to the seat member, and a thigh-engaging portion disposed outwardly of the seat member. The thigh-engaging portions of the first and second swing rods can be pressed toward each other. A biasing damper includes a piston disposed within an inner chamber in the pivot end portion of the first swing rod, a fluid filled within the inner chamber, and a resilient member for biasing the piston to move within the inner chamber in a first direction. The piston is connected to the pivot end portion of the second swing rod such that pivoting movement of the first and second swing rods toward each other is converted into movement of the piston within the inner chamber in a second direction opposite to the first direction.

9 Claims, 12 Drawing Sheets

THIGH EXERCISER

BACKGROUND OF THE INVENTION

1. Field of the Invention

This invention relates to a muscle exerciser, and more particularly to a thigh exerciser.

2. Description of the Related Art

Referring to FIG. 1, a conventional thigh exerciser 100 includes a pair of vertically extending slide rails 101 assembled within a generally vertical frame 1, and a stack of weights 102 through which the slide rails 101 are inserted. The vertical frame 1 has top and bottom support bars 2, 3 extending forwardly and respectively from central top and bottom ends thereof. The bottom support bar 3 has a front end connected with a seat frame 4. The top support bar 2 has a front end connected with a front support bar 5 which extends downwardly and inclinedly therefrom and which has a bottom end connected to the seat frame 4. A backrest member 501 and a seat member 401 are respectively connected to a middle section of the front support bar 5 and a top portion of the seat frame 4. The seat member 4 is provided with a pair of support tubes 402 below the seat member 401. The support tubes 402 of the seat member 4 are connected respectively with rotary discs 404 at top ends thereof, and are sleeved respectively onto axial rods 403. Cooperation between the support tubes 402 and the axial rods 403 may be used to vary the opening angle of the thigh exerciser 100 in a known manner. The rotary discs 404 are fixed respectively with support rods 405, each projecting outwardly from a top face of the respective rotary disc 404. The support rod 405 of each rotary disc 404 is connected with a knee support 406 and an upright pad 407. The axial rods 403 are fixed respectively with sector-shaped cams 408 at bottom ends thereof. The sector-shaped cams 408 are connected respectively with two belts 6 that wrap respectively around the sector-shaped cams 408. The belt 6 is connected to a pulley unit 103, which is connected pivotally to the bottom support bar 3, another pulley unit 301 mounted on the top end of the vertical frame 1, and the stack of weights 102.

To use the conventional thigh exerciser 100, a user sits on the seat member 401 with his/her back on the backrest 501 and his/her legs straddled over the respective knee supports 406. The thighs of the user then press the upright pads 407 toward each other, urging the support rods 405, the rotary discs 404, the support tubes 402, the axial rods 403, and the sector-shaped cams 408 to rotate synchronously, thereby permitting the belt 6 to lift the stack of weights 102. The combined force applied by the user's thighs at this time must be sufficient to lift the stack of weights 102 so as to achieve training of the user's thigh muscles.

Although the conventional thigh exerciser 100 can achieve its intended purpose, the structure of the conventional thigh exerciser 100 is complicated and bulky. Furthermore, in the case where the user has selected to exercise with a large number of the weights from the stack of weights 102, when the applied force of the user's thighs is released so as to proceed with the next pressing movement (i.e., during the negative portion of a repetition), the stack of the weights 102 is prone to quickly fall. If this occurs, the upright pads 407 are abruptly moved toward their original positions, which may result in injure to the user's thighs. Moreover, when the user desires to adjust the load to enhance training of the thigh muscles, he/she has to move to the back of the thigh exerciser 100 and manipulate the stack of weights 102 in a know manner. This is a troublesome process.

SUMMARY OF THE INVENTION

Therefore, the object of this invention is to provide a thigh exerciser that has a simple structure, that is convenient to carry, and that can minimize sports injures.

According to this invention, a thigh exerciser includes a pair of horizontal first and second swing rods each having a pivot end portion connected pivotally to the seat member, and a thigh-engaging portion disposed outwardly of the seat member. The thigh-engaging portions of the first and second swing rods can be pressed toward each other. A biasing damper includes a piston disposed within an inner chamber in the pivot end portion of the first swing rod, a fluid filled within the inner chamber, and a resilient member for biasing the piston to move within the inner chamber in a first direction. The piston is connected to the pivot end portion of the second swing rod such that pivoting movement of the first and second swing rods toward each other is converted into movement of the piston within the inner chamber in a second direction opposite to the first direction.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
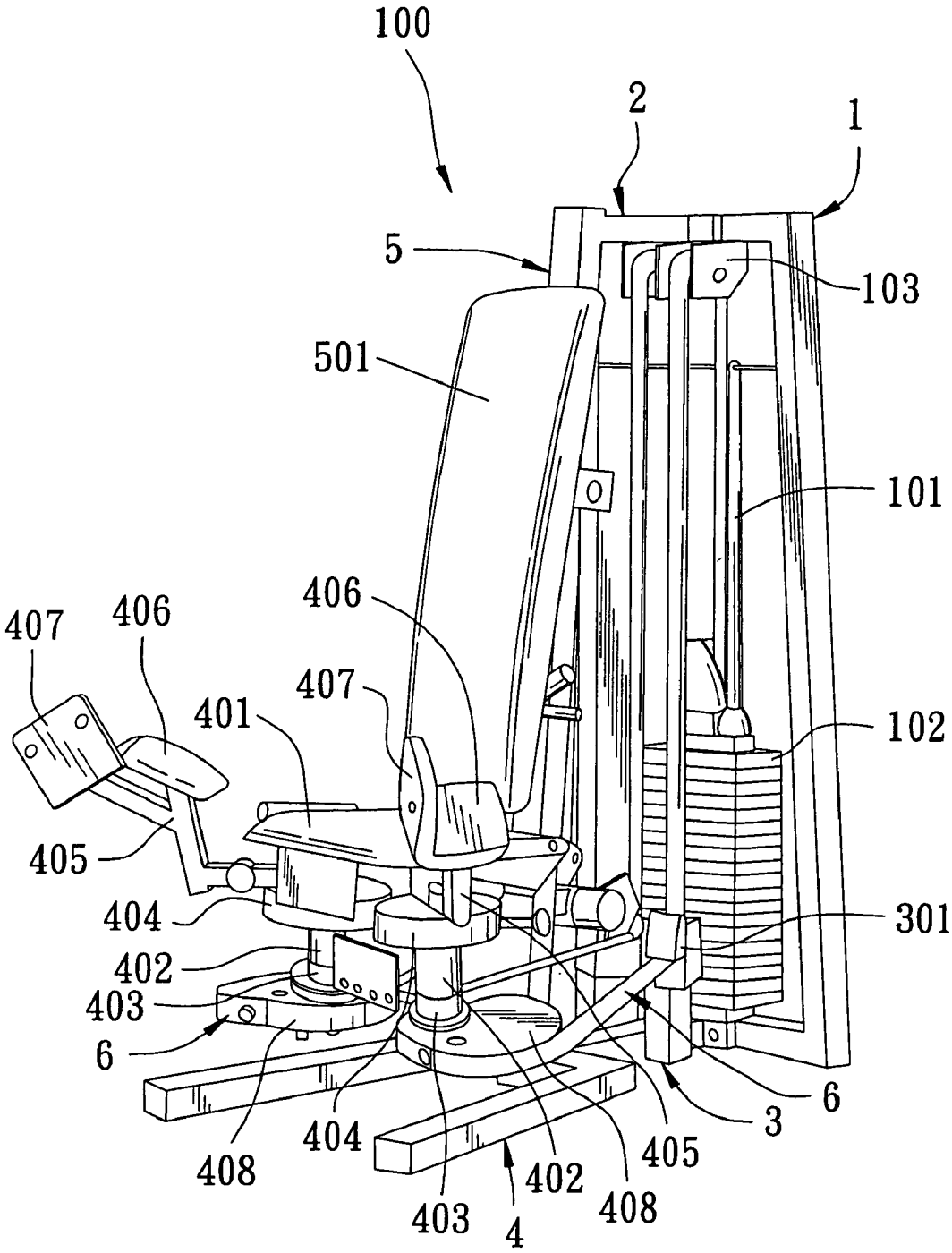
FIG. 1 PRIOR ART
FIG. 1 is a perspective view of a conventional thigh exerciser.

Before the present invention is described in greater detail in connection with the preferred embodiments, it should be noted that similar elements and structures are designated by like reference numerals throughout the entire disclosure.

Figure 2:
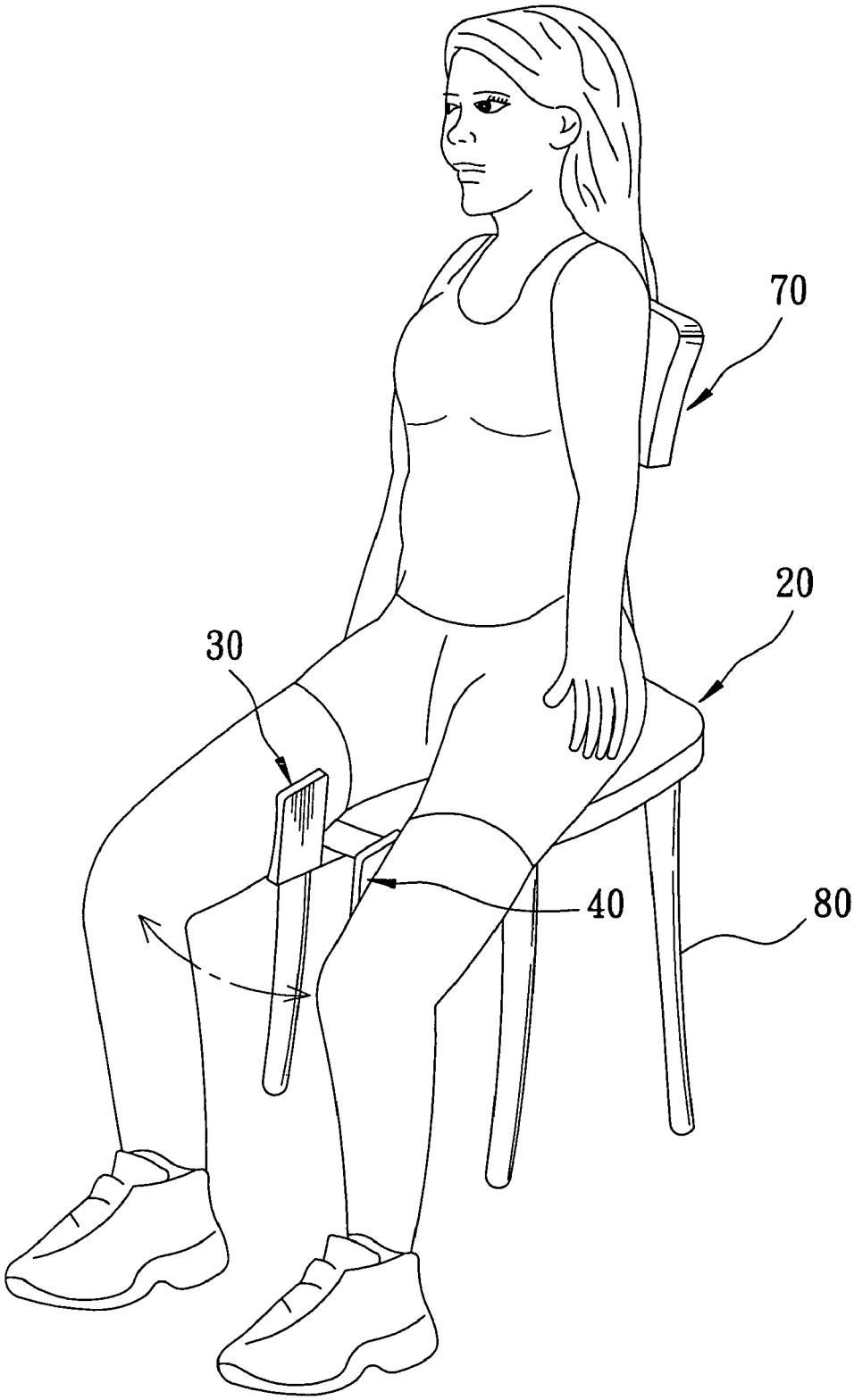
FIG. 2 is a perspective view of the first preferred embodiment of a thigh exerciser according to this invention, illustrating how the thigh exerciser is used.
Figure 3:
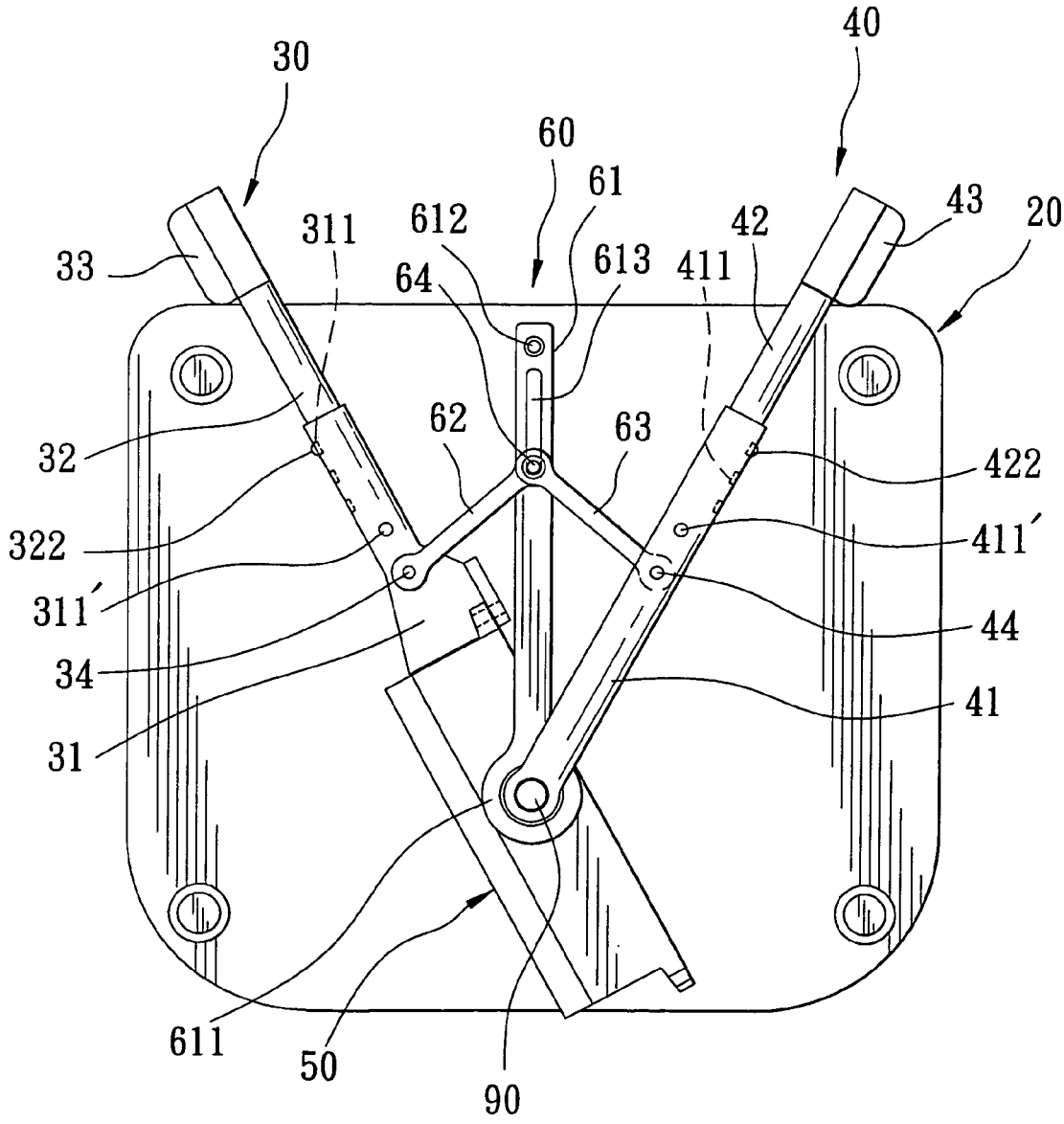
FIG. 3 is a bottom view of the first preferred embodiment when first and second swing rods are disposed in outer positions.

Referring to FIGS. 2 and 3, the first preferred embodiment of a thigh exerciser according to this invention includes a seat member 20 configured as a horizontal plate, a pair of horizontal first and second swing rods 30, 40, a biasing damper 50, a linkage 60, a backrest 70 connected fixedly to and disposed above the seat member 20, and a plurality of upright legs 80 having upper ends connected fixedly to a bottom surface of the seat member 20. An assembly of the seat member 20, the backrest 70, and the legs 80 constitutes a chair. An assembly of the first and second swing rods 30, 40, the biasing damper 50, and the linkage 60 is disposed on the bottom surface of the seat member 20. Each of the first and second swing rods 30, 40 has a pivot end portion 31, 41 connected pivotally to the seat member 20 by a vertical pivot rod 90, and a thigh-engaging portion 33, 43 disposed outwardly of the seat member 20. The pivot rod 90 is connected fixedly to the pivot end portion 41 of the second swing rod 40.

Figure 4:
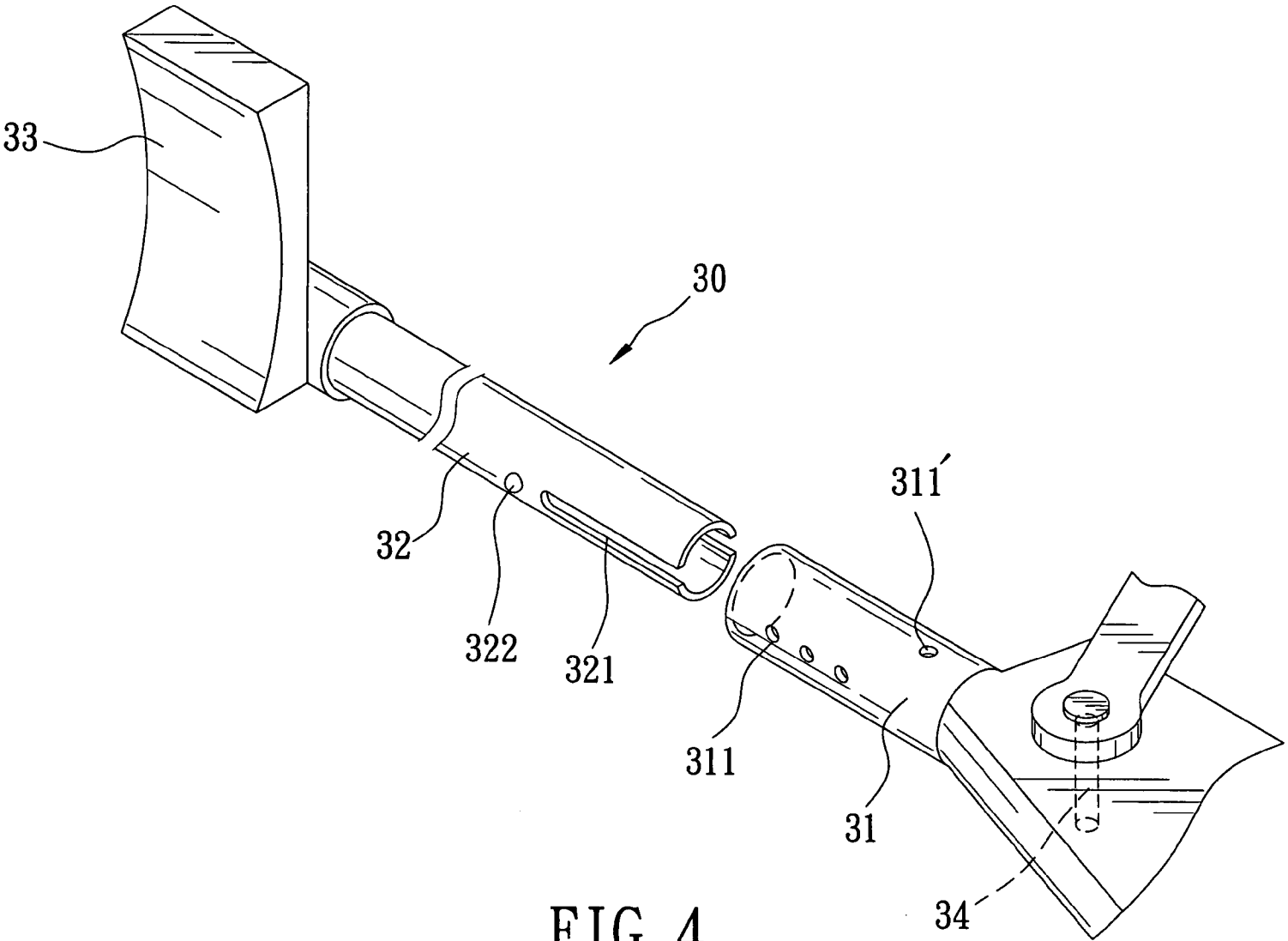
FIG. 4 is an exploded perspective view of the first swing rod of the first preferred embodiment.
Figure 4A:
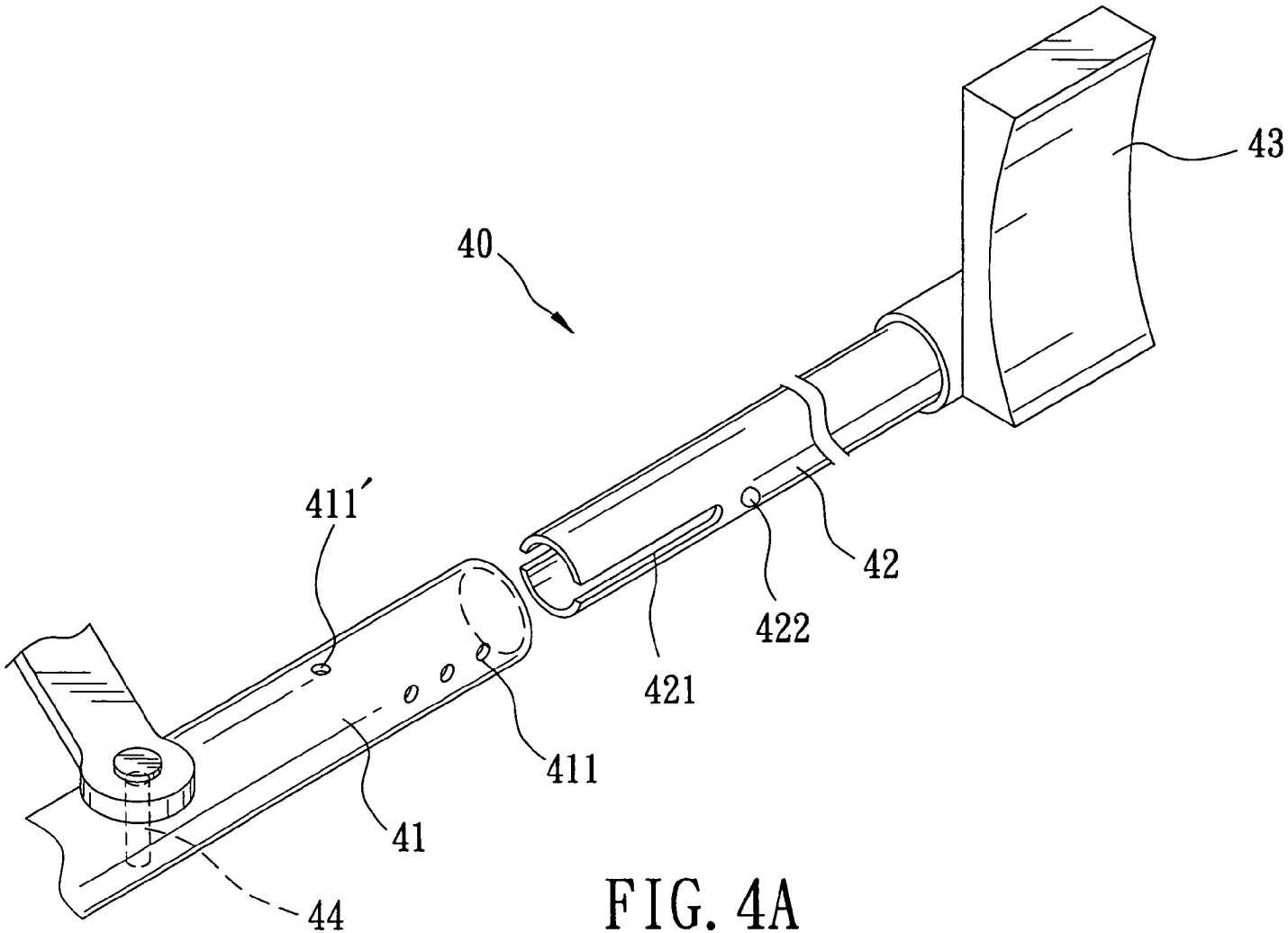
FIG. 4A is an exploded perspective view of the second swing rod of the first preferred embodiment.
Figure 5:
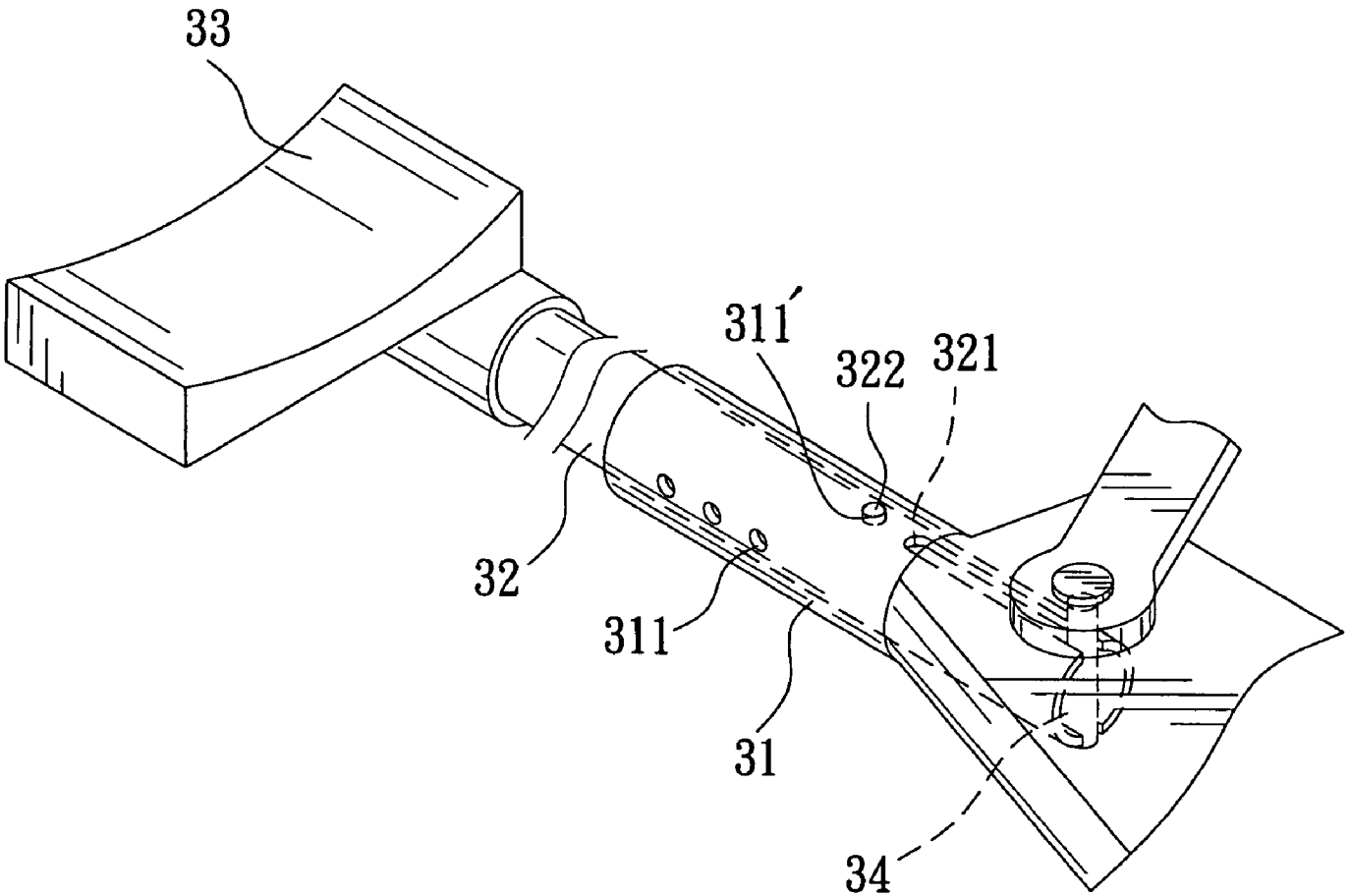
FIG. 5 is an assembled perspective view of the first swing rod of the first preferred embodiment, illustrating how a thigh-engaging portion of the first swing rod is maintained in an idle position.

With further reference to FIGS. 4, 4A, and 5, each of the first and second swing rods 30, 40 includes an outer tube 31, 41 serving as the pivot end portion, an inner tube 32, 42, and a positioning device for positioning the inner tube 32, 42 relative to the outer tube 31, 41 at a selected one of a plurality of positions. Each of the inner tubes 32, 42 has an inner end disposed telescopically within the outer tube 31, 41, and an outer end formed with the thigh-engaging portion 33, 43. Each of the thigh-engaging portions 33, 43 is configured as a plate formed with a curved thigh-engaging face in a known manner.

In this embodiment, each of the positioning devices includes an axial row of first positioning holes 311, 411 formed in the outer tube 31, 41, a second positioning hole 311', 411' formed in the outer tube 31, 41 and angularly spaced apart from first positioning holes 311, 411 by an angle of 90 degrees, two open-ended slots 321, 421 formed in the inner tube 32, and a spring-biased ball 322, 422 disposed on the inner tube 32 and engaging a selected one of the first and second positioning holes 311, 411, 311', 411'. As such, each of the thigh-engaging portions 33, 43 is pivotable relative to the outer tube 31, 41 between a vertical used position shown in FIG. 4 and a horizontal idle position shown in FIG. 5. In the used position, the spring-biased ball 322, 422 engages a selected one of the first positioning holes 311, 411. In the idle position, the spring-biased ball 322, 422 engages the second positioning hole 311', 411'. With the positioning device disposed between the inner and outer tubes 32, 31, 42, 41, the length of each of the first and second swing rods 30, 40 is adjustable.

Figure 7:
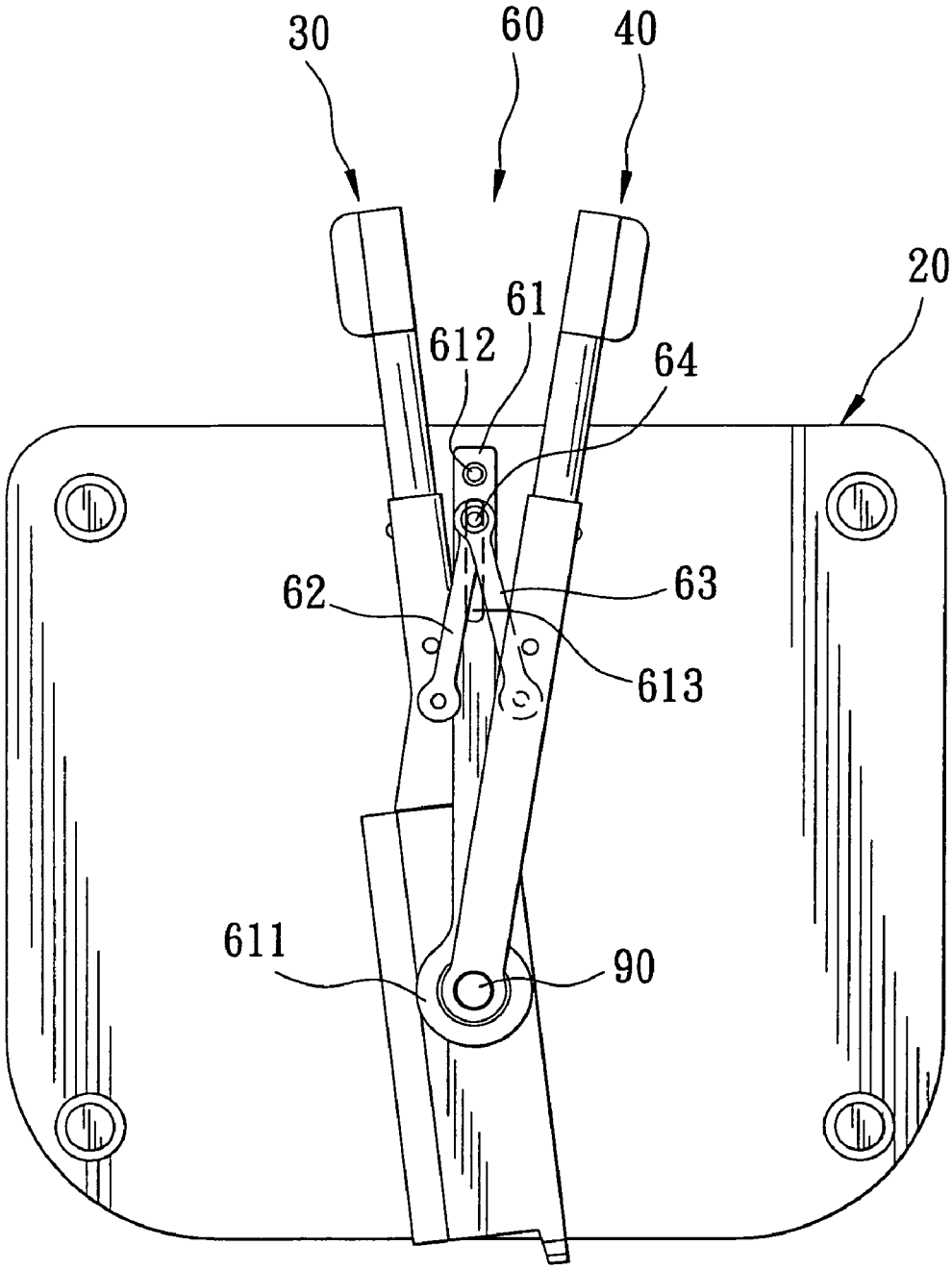
FIG. 7 is a bottom view of the first preferred embodiment when the first and second swing rods are disposed in inner positions.

The linkage 60 interconnects the first and second swing rods 30, 40 so as to allow for synchronous pivoting movement of the first and second swing rods 30, 40 toward and away from each other. As such, each of the first and second swing rods 30, 40 is pivotable between an inner position shown in FIG. 7 and an outer position shown in FIG. 3. The linkage 60 includes a fixed rod 61, a first link 62, a second link 63, and a pivot pin 64. The fixed rod 61 has a first end 611 sleeved on the pivot rod 90, a second end 612 opposite to the first end 611 and connected fixedly to the seat member 20, and an axially extending slide slot 613 formed between the first and second ends 611, 612. As such, the fixed rod 61 is disposed fixedly on the seat member 20.

Each of the first and second links 62, 63 has opposite inner and outer ends. The inner ends of the first and second links 62, 63 are interconnected pivotally by the pivot pin 64. The outer ends of the first and second links 61, 62 are connected respectively and pivotally to the first and second swing rods 30, 40 by two pivot pins 34, 44, respectively. When the spring-biased ball 322 of the inner tube 32 of the first swing rod 30 engages the second positioning hole 311' in the outer tube 31, the pivot pin 34 is disposed within the slots 321 in the inner tube 31, as shown in FIG. 5. Similarly, when the spring-biased ball 422 of the inner tube 42 of the second swing rod 40 engages the second positioning hole 411' in the outer tube 41, the pivot pin 44 is disposed within the slot 421 in the inner tube 41. The pivot pin 64 is received slidably within the slide slot 613 in the fixed rod 61.

Figure 6:
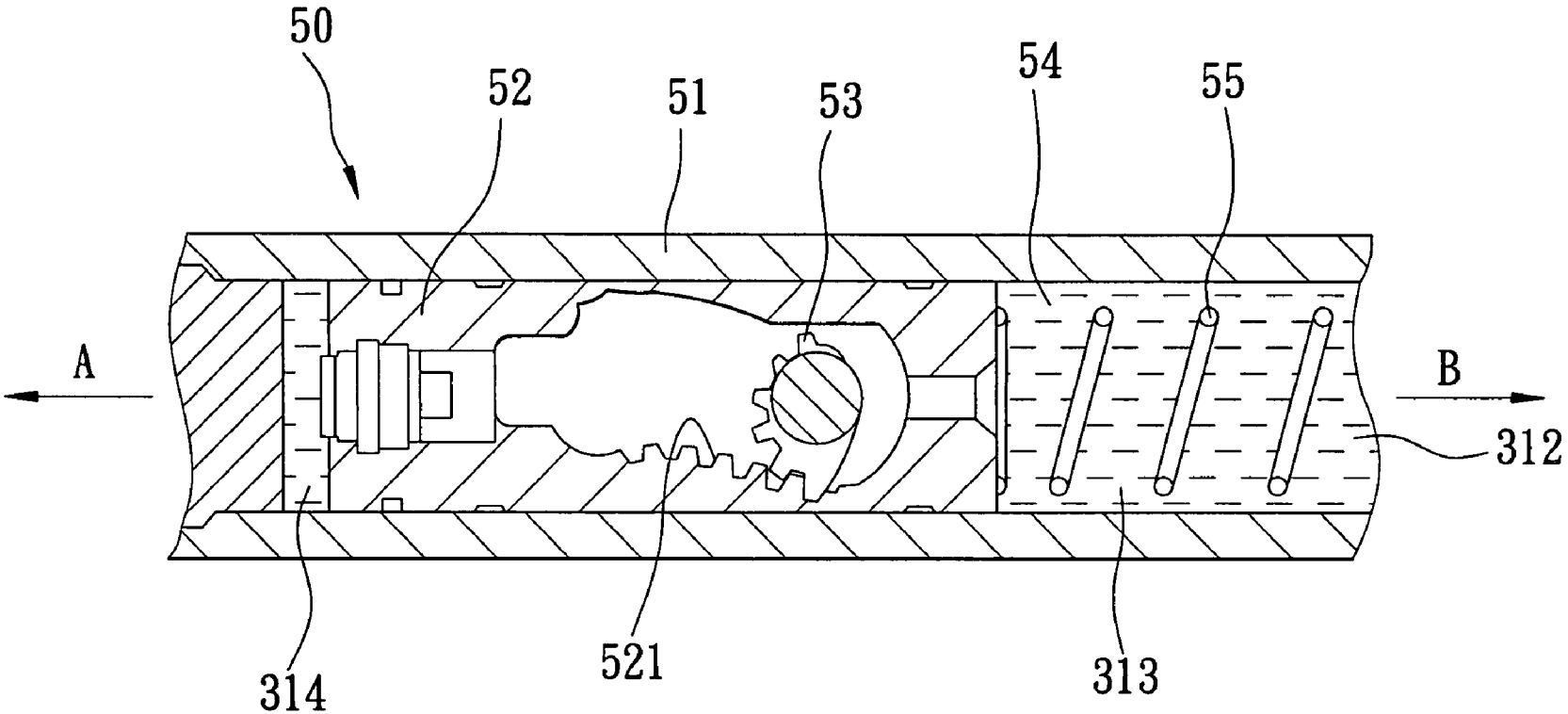
FIG. 6 is a fragmentary sectional view of a biasing damper of the first preferred embodiment.

With additional reference to FIG. 6, the biasing damper 50 includes a hollow piston 52, a pinion 53, a fluid 54, and a resilient member 55. The piston 52 is disposed sealingly and movably within the inner chamber 312 in the pivot end portion 31 of the first swing rod 30, and has an inner surface formed with a rack portion 521. The inner chamber 312 is filled with the fluid 54, and is divided into a pair of volume-variable first and second chamber portions 313, 314, which are located respectively to two opposite sides of the piston 52. The pinion 53 is sleeved fixedly on the pivot rod 90, and engages the rack portion 521 of the piston 52. As such, pivoting movement of the second swing rod 40 is converted into movement of the piston 52 within the inner chamber 312, and vice versa. The resilient member 55 is configured as a coiled compression spring, and is disposed within the first chamber portion 313 so as to bias the piston 52 to move toward the second chamber portion 314 in a first direction (A) to thereby pivot the first and second swing rods 30, 40 toward the outer positions. Thus, when the thigh-engaging portions 33, 43 of the first and second swing rods 30, 40 are pressed toward each other, the piston 52 moves within the inner chamber 312 in a second direction (B) opposite to the first direction (A) against the biasing action of the resilient member 55. Subsequently, when the force applied to the thigh-engaging portions 33, 43 is released, the first and second swing rods 30, 40 are biased and returned to the outer positions by the resilient member 55.

Figure 8:
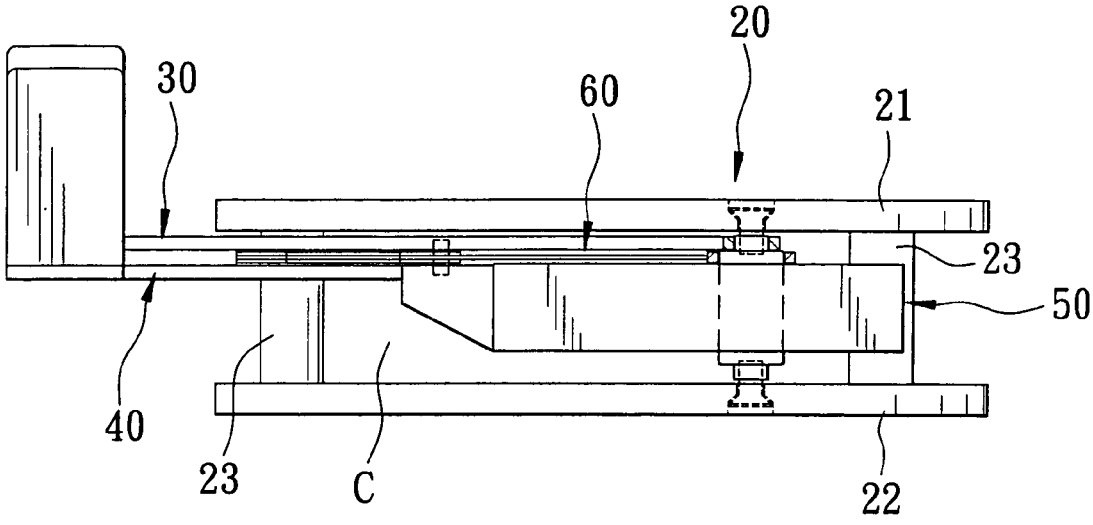
FIG. 8 is a side view of the second preferred embodiment of a thigh exerciser according to this invention, which includes a modified seat member.

FIG. 8 shows the second preferred embodiment of a thigh exerciser according to this invention, which includes a modified seat member 20. The modified seat member 20 includes a pair of horizontal top and bottom plates 21, 22, and a plurality of connecting posts 23 each having an upper end connected fixedly to the top plate 21, and a lower end connected fixedly to the bottom plate 22. The top and bottom plates 21, 22 define an accommodating space (C), within which the first and second swing rods 30, 40, the biasing damper 50, and the linkage 60 are disposed. During use, the bottom plate 22 is disposed on a chair (not shown), and the user sits on the top plate 21.

Figure 9:
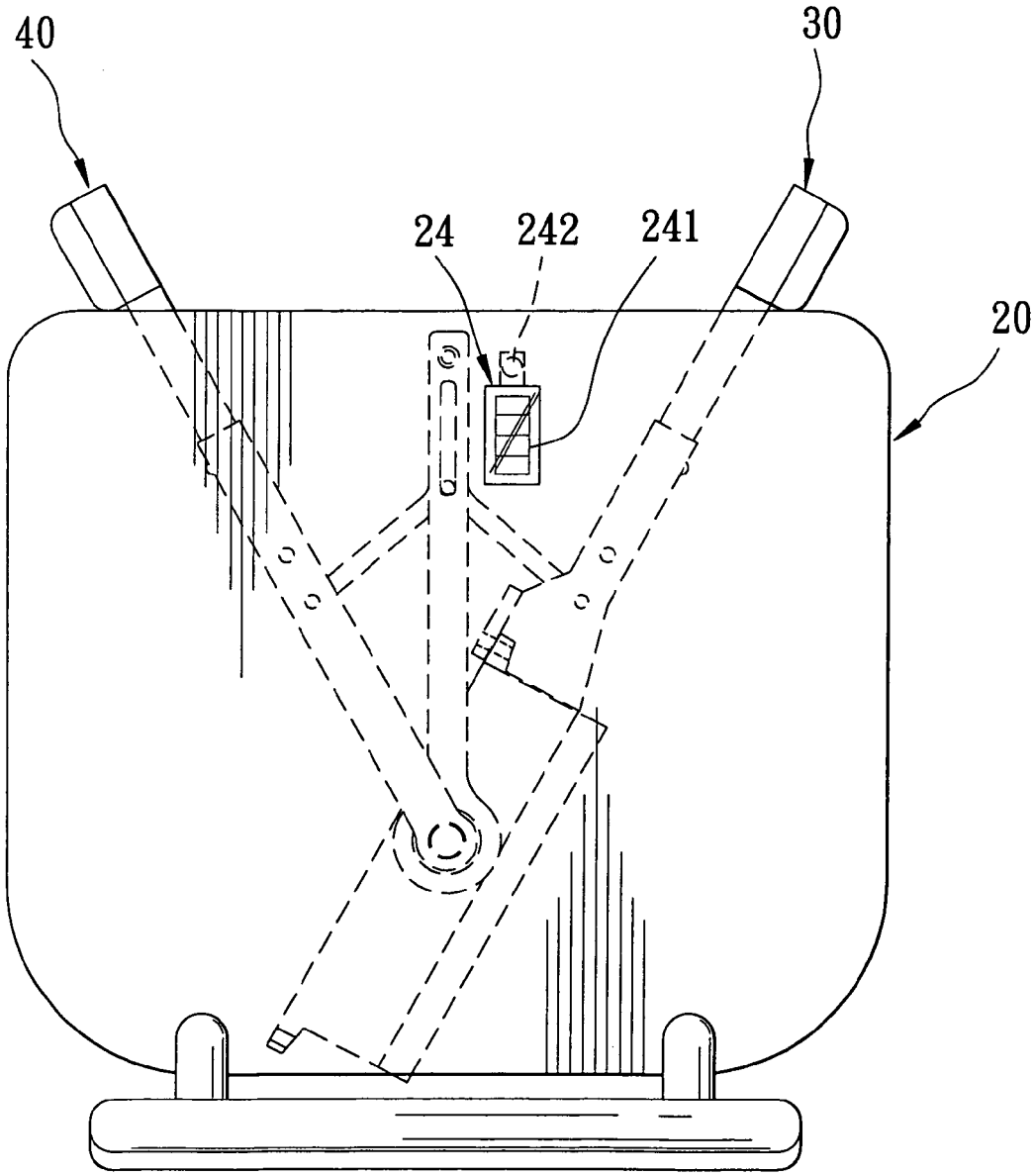
FIG. 9 is a top view of the third preferred embodiment of a thigh exerciser according to this invention.
Figure 10:
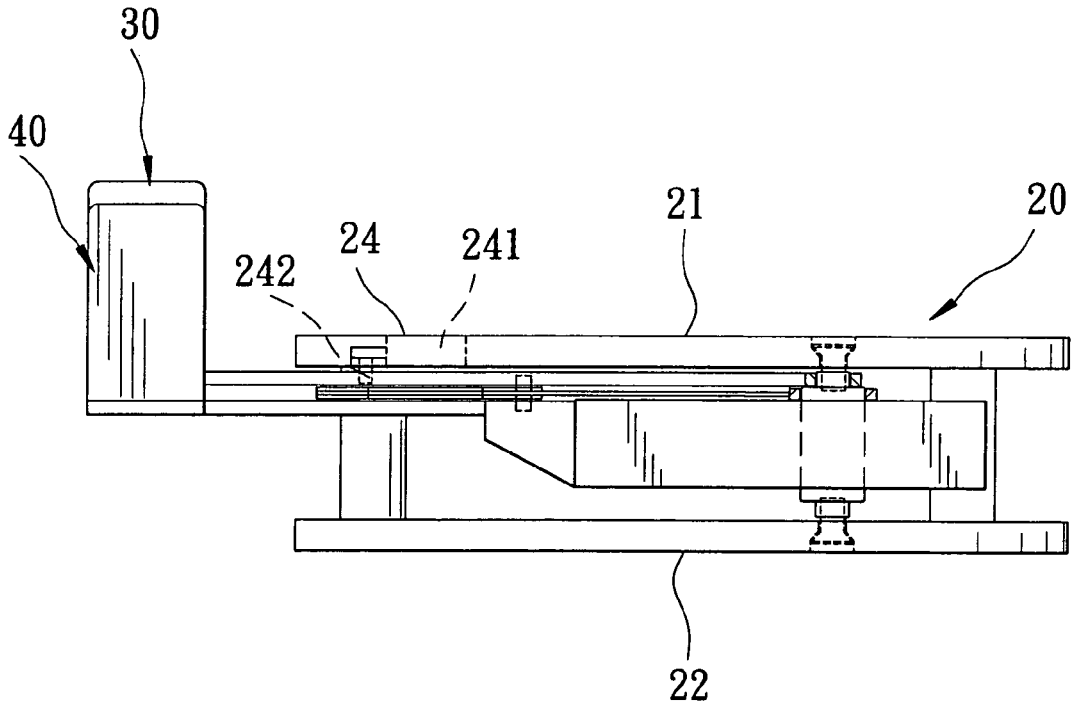
FIG. 10 is a side view of the third preferred embodiment, illustrating arrangement of a counter.

FIGS. 9 and 10 show the third preferred embodiment of a thigh exerciser according to this invention, which is similar in construction to the second preferred embodiment except that the seat member 20 further includes a counter 24. The counter 24 includes a display panel 241 and a press lever 242. The press lever 242 is disposed pivotally among the top and bottom plates 21, 22, and the first and second swing rods 30, 40. The press lever 242 is positioned such that, when the first swing rod 30 moves from the outer position to the inner position, it comes into contact with the press lever 242. The display panel 241 is disposed on the top plate 21, and is connected to the press lever 242 for displaying the number of times the first and second swing rods 30, 40 move from the outer positions to the inner positions.

Figure 11:
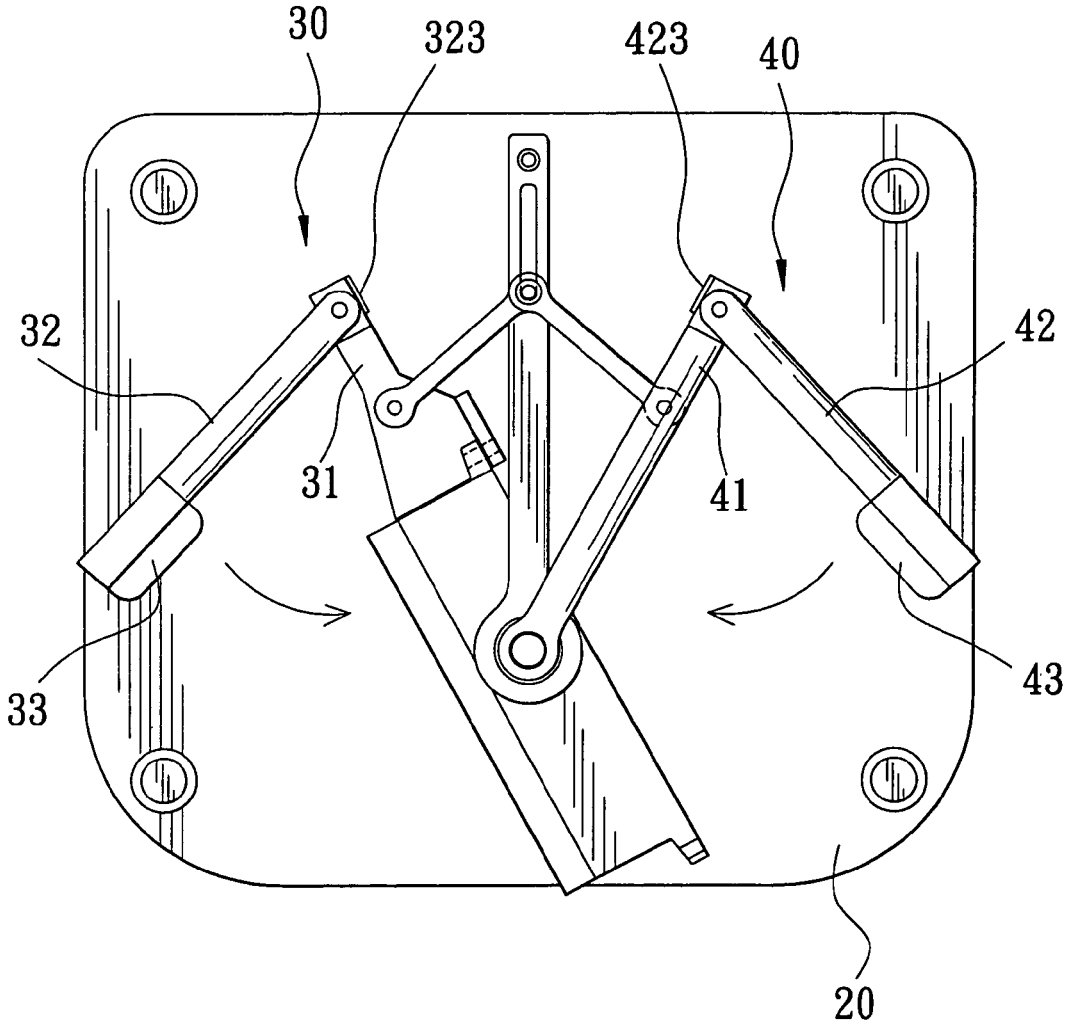
FIG. 11 is a bottom view of the fourth preferred embodiment of a thigh exerciser according to this invention, which includes modified first and second swing rods.

FIG. 11 shows the fourth preferred embodiment of a thigh exerciser according to this invention, which includes modified first and second swing rods 30, 40. Each of the modified first and second swing rods 30, 40 has a pivot end portion 31, 41 and a swingable rod section 32, 42. Each of the swingable rod sections 32, 42 is formed with the thigh-engaging portion 33, 43 at an end thereof, and is connected pivotally to the corresponding pivot end portion 31, 41 at an opposite end thereof at a position inside of an area encompassed by the seat member 20. Each of the pivot end portions 31, 41 is formed with an upright integral stop plate 323, 423. The stop plates 323, 423 are orientated so as to allow for pivoting movement of the thigh-engaging portions 33, 43 of the first and second swing rods 30, 40 relative to the pivot end portions 31, 42 away from each other, while preventing pivoting movement of the thigh-engaging portions 33, 43 relative to the pivot end portions 31, 42 toward each other. Therefore, when the thigh exerciser is not used, the swingable rod sections 32, 42 can be pivoted relative to the pivot end portions 31, 41 such that the swingable rod sections 32, 42 are located entirely inside of the area encompassed by the seat member 20, thereby reducing a storage space occupied by the thigh exerciser.

The thigh exerciser of this invention has the following advantages:

(1) The thigh exerciser has a simple structure.

(2) The volume of the thigh exerciser is reduced significantly, as compared to the above-mentioned prior art, and therefore is convenient to carry.

(3) The fluid 54 contained within the inner chamber 312 in the pivot end portion 31 of the first swing rod 30 can retard pivoting movement of the first and second swing rods 30, 40. This minimizes sports injures, particularly those resulting during the negative portion of a repletion using the above-mentioned prior art.

With this invention thus explained, it is apparent that numerous modifications and variations can be made without departing from the scope and spirit of this invention. It is therefore intended that this invention be limited only as indicated by the appended claims.

I claim:

1. A thigh exerciser comprising:

a seat member;

a vertical pivot rod;

a pair of horizontal first and second swing rods each having a pivot end portion connected pivotally to said seat member by said pivot rod, and a thigh-engaging portion disposed outwardly of said seat member, said thigh-engaging portions of said first and second swing rods being adapted to be pressed and pivoted toward each other by thighs of a user, said pivot end portion of said first swing rod being formed with an inner chamber;

a linkage interconnecting said first and second swing rods so as to allow for synchronous pivoting movement of said first and second swing rods toward and away from each other such that each of said first and second swing rods is pivotable between inner and outer positions; and a biasing damper including a piston disposed sealingly and movably within said inner chamber in said pivot end portion of said first swing rod and connected to said pivot end portion of said second swing rod such that pivoting movement of said second swing rod is converted into movement of said piston within said inner chamber and vice versa, said inner chamber being divided into a pair of volume-variable first and second chamber portions by said piston, a fluid filled within said inner chamber in said pivot end portion of said first swing rod, and a resilient member disposed within said first chamber portion of said inner chamber in said pivot end portion of said first swing rod for biasing said piston to move toward said second chamber portion of said inner chamber so as to pivot said first and second swing rods toward said outer positions.

2. The thigh exerciser as claimed in claim 1, wherein said linkage includes:

a fixed rod disposed fixedly on said seat member and formed with a slide slot;

a first link having an outer end connected pivotally to said first swing rod, and an inner end opposite to said outer end of said first link;

a second link having an outer end connected pivotally to said second swing rod, and an inner end opposite to said outer end of said second link; and a pivot pin interconnecting pivotally said inner ends of said first and second links and received slidably within said slide slot in said fixed rod.

3. The thigh exerciser as claimed in claim 1, wherein said seat member is configured as a horizontal plate, an assembly of said first and second swing rods, said linkage, and said biasing damper being disposed on a bottom surface of said seat member, said thigh exerciser further comprising a plurality of upright legs having upper ends connected fixedly to said bottom surface of said seat member, and a backrest connected fixedly to and disposed above said seat member, an assembly of said seat member, said legs, and said backrest constituting a chair.

4. The thigh exerciser as claimed in claim 1, wherein said seat member includes a pair of horizontal top and bottom plates, and a plurality of connecting posts each having an upper end connected fixedly to said top plate, and a lower end connected fixedly to said bottom plate, said top and bottom plates defining an accommodating space, within which said first and second swing rods, said linkage, and said biasing damper are disposed.

5. The thigh exerciser as claimed in claim 4, wherein said seat member further includes a counter, said counter including:

a press lever disposed pivotally among said top and bottom plates, and said first and second swing rods such that one of said first and second swing rods comes into contact with said press lever when said first and second swing rods move from said outer positions to said inner position; and a display panel connected to said press lever and disposed on said top plate for displaying the number of times said first and second swing rods move from said outer positions to said inner positions.

6. The thigh exerciser as claimed in claim 1, wherein each of said first and second swing rods further has a swingable rod section formed with said thigh-engaging portion at an end thereof and connected pivotally to said pivot end portion of a corresponding one of said first and second swing rods at an opposite end thereof at a position inside of an area encompassed by said seat member so as to allow said swingable rod section of each of said first and second swing rods to be pivoted relative to said pivot end portion of the corresponding one of said first and second swing rods and thus located entirely inside of the area encompassed by said seat member, said pivot end portion of each of said first and second swing rods being formed with an upright integral stop plate orientated so as to allow for pivoting movement of said thigh-engaging portions of said first and second swing rods relative to said pivot end portions of said first and second swing rods away from each other, while preventing pivoting movement of said thigh-engaging portions of said first and second swing rods relative to said pivot end portions of said first and second swing rods toward each other.

7. The thigh exerciser as claimed in claim 1, wherein each of said first and second swing rods includes an outer tube serving as said pivot end portion, an inner tube having an inner end disposed telescopically within said outer tube, and an outer end formed with said thigh-engaging portion, and a positioning device for positioning said inner tube relative to said outer tube at a selected one of a plurality of positions.

8. The thigh exerciser as claimed in claim 7, wherein said positioning device includes a plurality of positioning holes formed in said outer tube, and a spring-biased ball disposed on said inner tube and engaging a selected one of said positioning holes in said outer tube.

9. The thigh exerciser as claimed in claim 7, wherein said positioning device includes:

an axial row of first positioning holes formed in said outer tube;

a second positioning hole formed in said outer tube and angularly spaced apart from said first positioning holes by an angle of 90 degrees; and a spring-biased ball disposed on said inner tube and engaging a selected one of said first and second positioning holes in said outer tube.

* * * * *